US006719248B2

(12) United States Patent
Lamont

(10) Patent No.: US 6,719,248 B2
(45) Date of Patent: Apr. 13, 2004

(54) ANTI-FATIGUE PLATFORM

(76) Inventor: Gordon Lamont, 5205—62 Street, Lloydminster, Alberta (CA), T9V 2E3

( * ) Notice: Subject to any disclaimer, the term of this patent is extended or adjusted under 35 U.S.C. 154(b) by 0 days.

(21) Appl. No.: 09/909,278

(22) Filed: Jul. 19, 2001

(65) Prior Publication Data

US 2002/0008181 A1 Jan. 24, 2002

(30) Foreign Application Priority Data

Jul. 20, 2000 (CA) ..... 2314476

(51) Int. Cl.[7] ..... A47C 1/00
(52) U.S. Cl. ..... 248/121; 248/125.1; 297/461
(58) Field of Search ..... 248/121, 125.1, 248/125.3; 297/461, 463.2

(56) References Cited

U.S. PATENT DOCUMENTS

| | | | | | |
|---|---|---|---|---|---|
| 3,477,673 | A | * | 11/1969 | Bereday | 248/121 |
| 3,704,847 | A | * | 12/1972 | Schmitt | 248/127 |
| 4,366,981 | A | * | 1/1983 | Ziegler et al. | 297/328 |
| D329,538 | S | * | 9/1992 | Rau | D3/9 |
| 5,149,174 | A | | 9/1992 | Charash | 297/423 |
| 5,199,763 | A | * | 4/1993 | Wilder et al. | 297/338 |
| 5,295,728 | A | * | 3/1994 | Schaevitz | 297/195.1 |
| 5,441,433 | A | * | 8/1995 | Stanley | 441/130 |
| 5,558,606 | A | | 9/1996 | Poncini et al. | 482/79 |
| D393,373 | S | * | 4/1998 | Acosta | D6/349 |
| 5,813,947 | A | | 9/1998 | Densmore | 482/51 |
| 5,885,190 | A | | 3/1999 | Reiter | 482/69 |
| D441,093 | S | * | 4/2001 | Johnson | D25/62 |

FOREIGN PATENT DOCUMENTS

| | | |
|---|---|---|
| CA | 74397 | 6/1994 |
| CA | 82241 | 10/1997 |

OTHER PUBLICATIONS

Muscles Alive by John V. Basmajian, Fourth Edition, 1979, Chapter 13, p. 281–193.

Muscles Alive by John V. Basmajian, Fourth Edition, 1979, Chapter 9, p. 175–185.

* cited by examiner

*Primary Examiner*—Korie Chan
*Assistant Examiner*—Steven Marsh
(74) *Attorney, Agent, or Firm*—Davis & Bujold, PLLC

(57) ABSTRACT

An anti-fatigue platform includes a resilient body having a flat bottom surface and a sloped upper surface. The sloped upper surface promotes vertical equilibrium and relieves lower and mid back muscular stress when a worker is standing for long periods of time.

10 Claims, 13 Drawing Sheets

ANTI-FATIGUE PLATFORM

FIELD OF THE INVENTION

The present invention relates to an anti-fatigue platform.

BACKGROUND OF THE INVENTION

There are numerous occupations which require workers to remain standing, such as grocery store checkout clerks and assembly line workers. As a result of standing for long periods of time, the workers experience fatigue. The ergonomic response to such fatigue has been the development of fatigue mats. Existing fatigue mats are flat cushioned surfaces that workers stand upon.

SUMMARY OF THE INVENTION

The present invention relates to an anti-fatigue platform, that will provide an alternative to fatigue mats.

According to the present invention there is provided an anti-fatigue platform which includes a resilient body having a flat bottom surface and a sloped upper surface which the worker stands on.

Having a anti-fatigue platform with a sloped surface promotes vertical equilibrium and reduces lower and mid back muscular stress. When the sloped surface has a constant slope, for the comfort of the user, the sloped upper surface should be not less than 5 degrees and not more than 35 degrees. If the slope is less than 5 degrees, there is very little difference to standing on a flat fatigue mat. If the slope is more than 35 degrees, the slope is too great to maintain vertical equilibrium for a long period of time and may increase, rather than reduce, fatigue.

Although beneficial results may be obtained through the use of the anti-fatigue platform, as described above, it is preferred that the sloped surface have a curvature. The best form of curvature has been found to be provided by an ellipsoid which is truncated to form the flat bottom surface. Such a body has a sloped front surface with the slope of the front surface being greater than the slope of the upper surface. It has been found that a worker is most comfortable when he or she can vary the angular position on which he or she stands with either or both feet at any given time. When the angle of curvature varies between the upper surface and the front surface, the worker can vary his or her angular position by moving forward or backward, or shifting the feet to a non-parallel alignment.

Although beneficial results may be obtained through the use of the anti-fatigue platform, as described above, the anti-fatigue platform is easier to store and less expensive to manufacture when its size is reduced. Even more beneficial results may, therefore, be obtained when the body has a truncated back surface. The truncation of the back surface reduces the size of the body and provides a "drop" against which one may stretch their calf muscles.

Although beneficial results may be obtained through the use of the anti-fatigue platform, as described above, fatigue can further be reduced when the worker is supported from behind. Even more beneficial results may, therefore, be obtained when the body has a vertical support post. It is preferred that the vertical support post have a transverse member against which a worker may lean the back of his or her legs. It is also preferred that the vertical support post have a first portion and a second portion, with the second portion being telescopically adjustable relative to the first portion. This enables the transverse member to be positioned at a comfortable height appropriate to the height of the user. It is also preferred that the transverse member have a main body and remote ends, with the remote ends being angularly offset from an axis of the main body.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
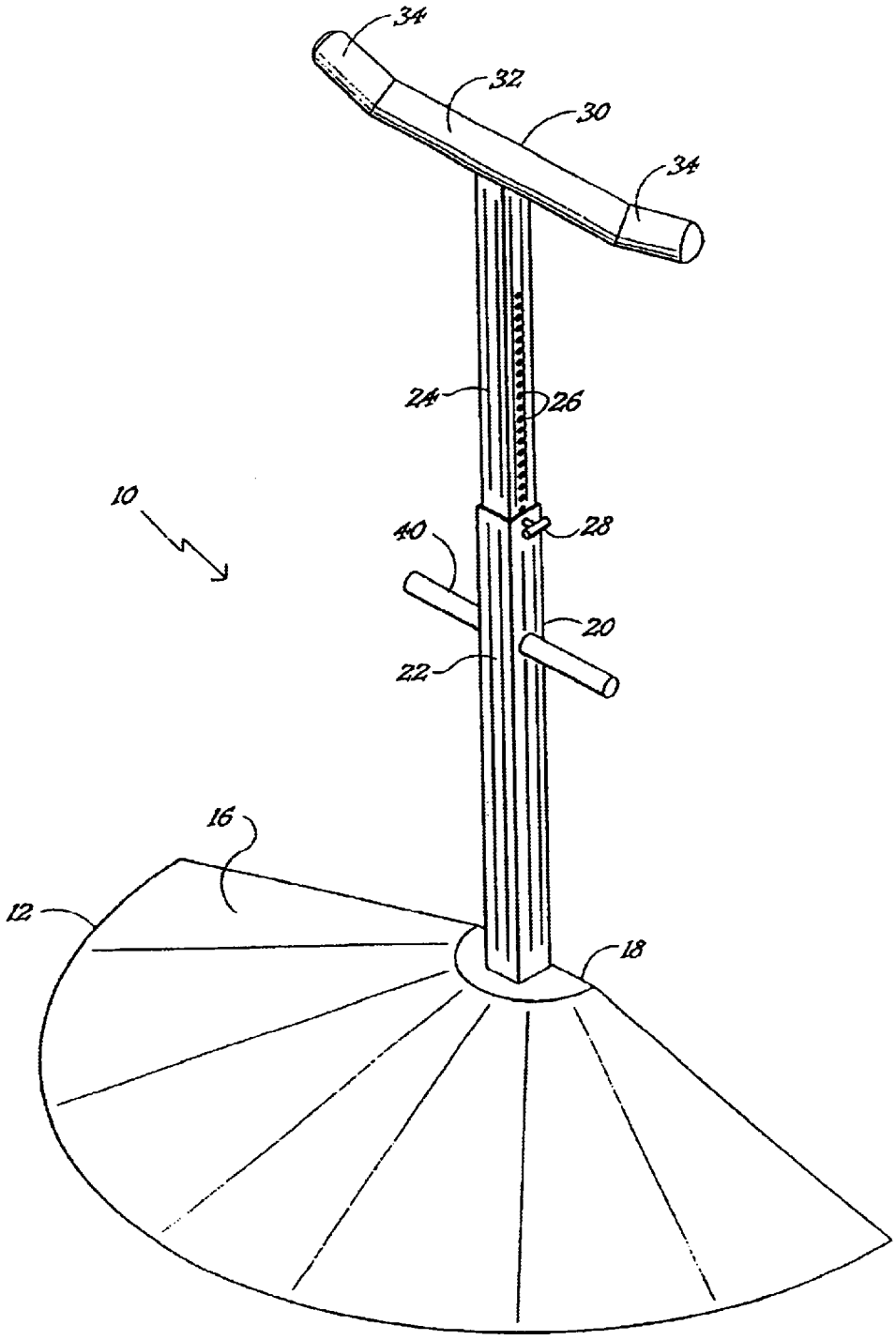
FIG. 1 is a perspective view of a first embodiment of anti-fatigue platform constructed in accordance with the teachings of the present invention.

A first embodiment of anti-fatigue platform, generally identified by reference numeral 10, will now be described with reference to FIGS. 1 through 5. A second embodiment of anti-fatigue platform, generally identified by reference numeral 100, will now be described with reference to FIGS. 6 through 10. A third embodiment of anti-fatigue platform, generally identified by reference numeral 200, will now be described with reference to FIGS. 11 through 15.

Structure and Relationship of Parts of First Embodiment

Figure 2:
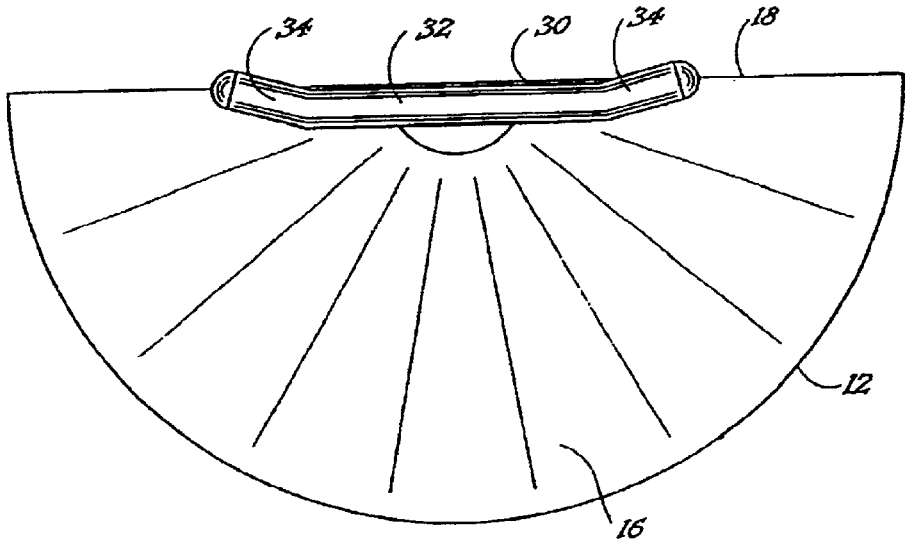
FIG. 2 is a top plan view of the anti-fatigue platform illustrated in FIG. 1.
Figure 3:
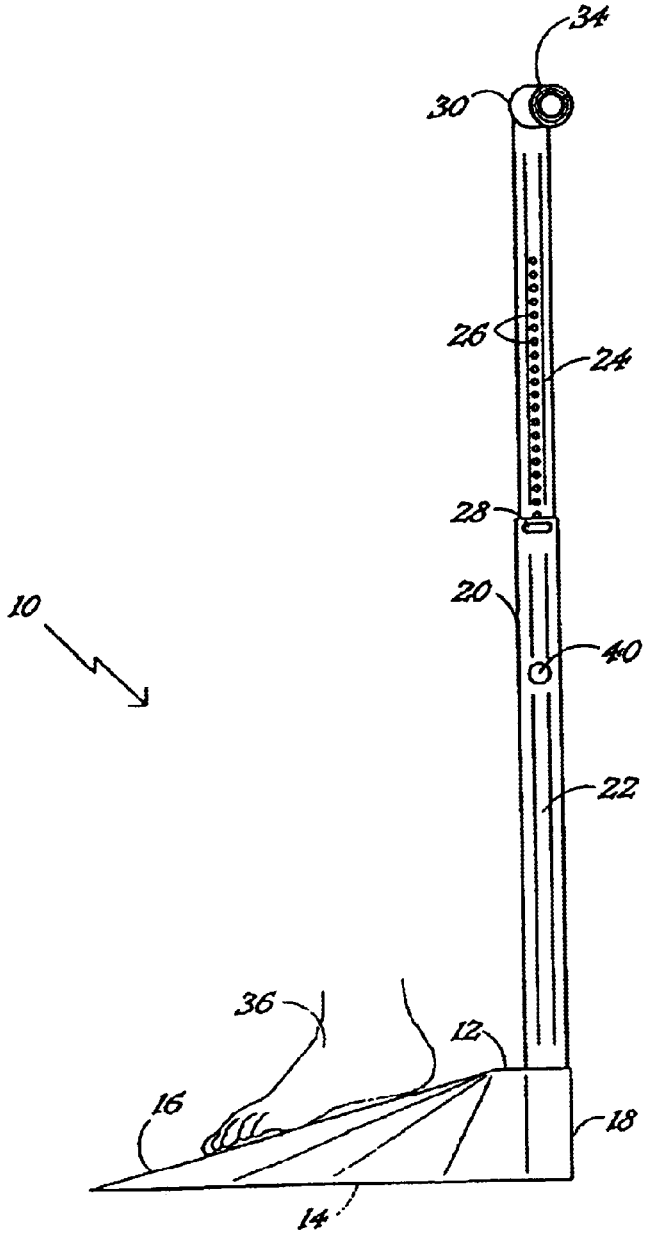
FIG. 3 is a side elevation view of the anti-fatigue platform illustrated in FIG. 1.
Figure 4:
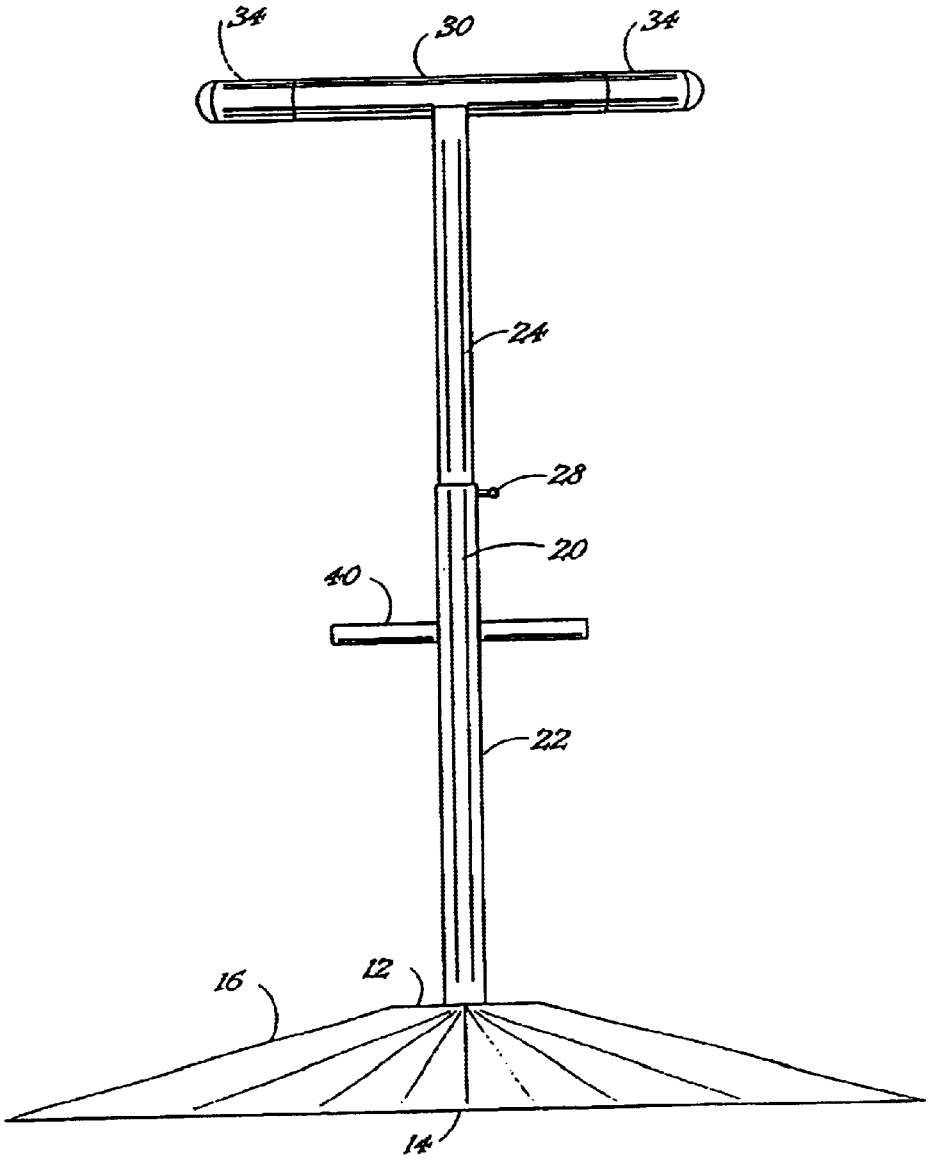
FIG. 4 is a front elevation view of the anti-fatigue platform illustrated in FIG. 1.
Figure 5:
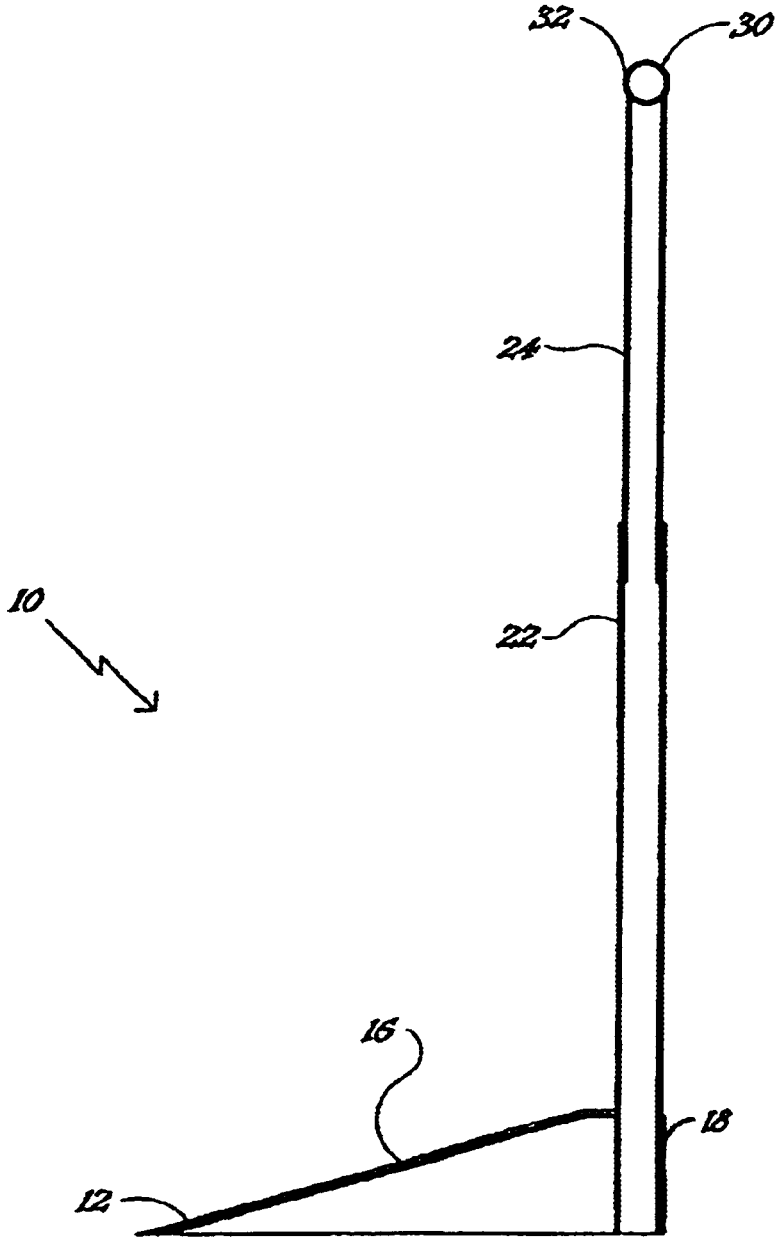
FIG. 5 is a side elevation view, in section, of the anti-fatigue platform illustrated in FIG. 1.

Referring to FIGS. 1 through 5, anti-fatigue platform 10 includes a resilient body 12 having a flat bottom surface 14, a downwardly sloped semi-circular upper surface 16, and a truncated back 18 as illustrated in FIG. 2. Sloped upper surface 16 has a substantially constant slope of not less than 5 degrees and not more than 35 degrees. If the slope is less than 5 degrees, there is little difference to standing on a flat fatigue mat. If the slope is more than 35 degrees, the slope is too great to stand comfortably for a long period of time and fatigue may increase rather than decrease. Referring to FIGS. 3 and 4, a support post 20 projects vertically from body 12. Vertical support post 20 is comprised of a first portion 22 and a second portion 24. Referring to FIG. 5, first portion 22 is fixed to resilient body 12 while second portion 24 is telescopically adjustable relative to first portion 22. Second portion 24 has a plurality of vertically spaced adjustment apertures 26. Second portion 24 is fixed in a position relative to first portion 22 by insertion of a locking pin 28 through one of adjustment apertures 26. In order to adjust the height of support post 20, locking pin 28 is removed and second portion 24 can then be moved either up or down until the desired height is reached. Locking pin 28 is then inserted through corresponding adjustment aperture 26 in second portion 24 so as to lock second portion 24 in position relative to first portion 22. Referring to FIG. 1, vertical support post 20 has a transverse member 30. Transverse member 30 has a main body 32 and remote ends 34. Remote ends 34 are angularly offset from an axis of main body 32 on a substantially horizontal plane. A foot rest 40 is positioned on first portion 22 of support post 20.

Operation of the First Embodiment

The use and operation of anti-fatigue platform 10 will now be described with reference to FIGS. 1 through 5. A worker who is required to stand for a period of time, may reduce fatigue, particularly in the lower and mid back, by standing on anti-fatigue platform 10. Referring to FIG. 3, the worker places his or her feet 36 on resilient body 12 at any position that feels comfortable along sloped upper surface 16. During use, a worker can relieve fatigue by moving either or both feet up or down sloped upper surface 16. Both feet can be maintained parallel or one foot can be toward the top of sloped upper surface 16, while the other foot is positioned toward the bottom of sloped upper surface 16. In addition, the worker can change the width of his or her stance and the direction the feet are pointing in relation to the semi-circular configuration of sloped upper surface 16. Toes can be pointed inwardly or toes can be pointed outwardly. The worker can also obtain additional support from support post 20. Second portion 24 of support post 20 can be moved up or down until a desired height is reached. Locking pin 28 can be inserted through a selected one of adjustment apertures 26 to lock second portion 24 a desired height relative to first portion 22. Transverse member 30 should be positioned to engage the back of the thighs. If the worker prefers, the height may be raised to engage the buttocks. This enables the worker is able to lean the back of his or her upper legs or buttocks against transverse member 30 for additional comfort. For variation, the worker stand on one foot and can rest his other foot on foot rest 40. It is anticipated that the worker will periodically stretch, this is done by handing one foot over truncated back 18.

Structure and Relationship of Parts of Second Embodiment

Figure 6:
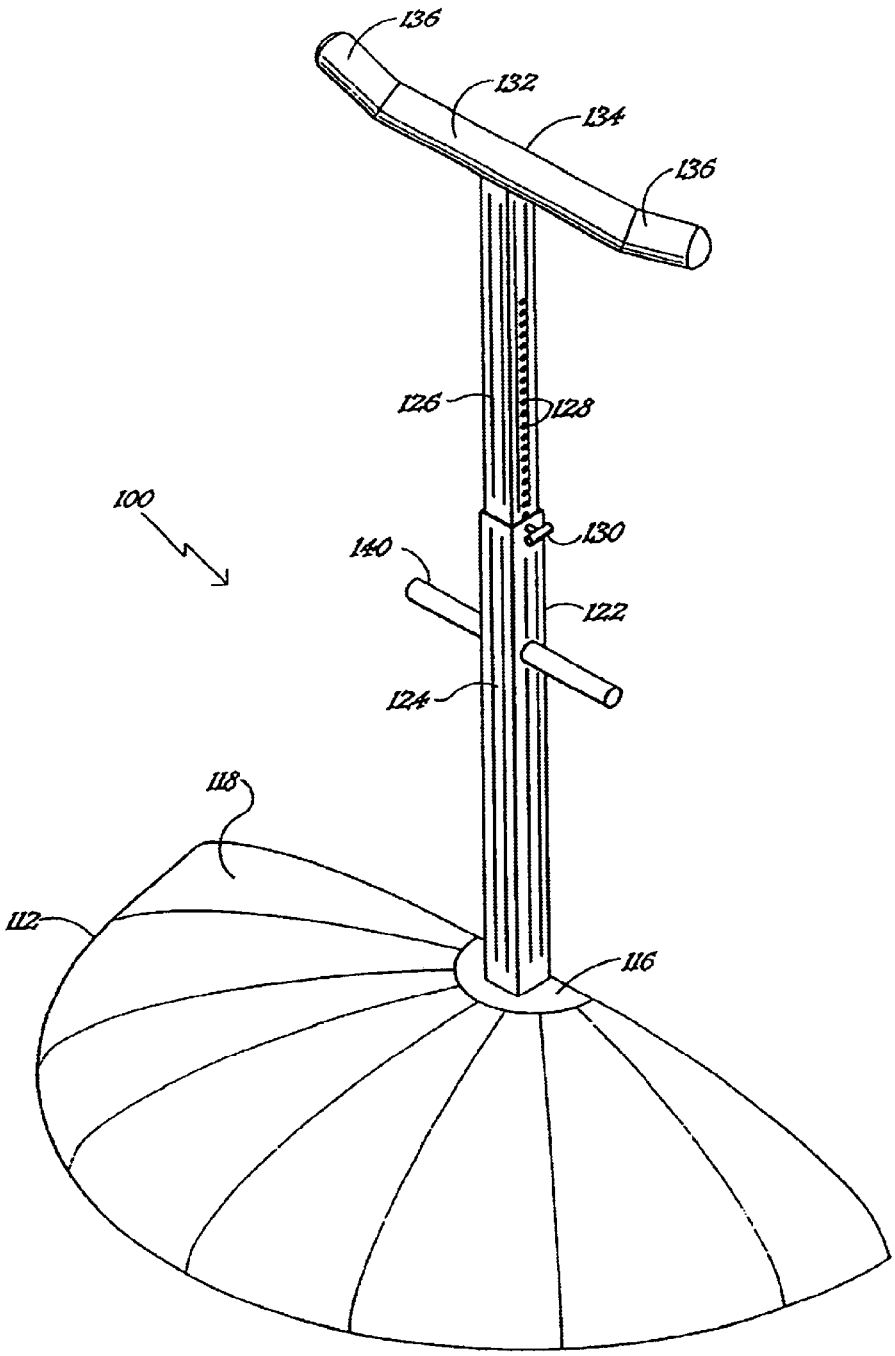
FIG. 6 is a perspective view of a second embodiment of anti-fatigue platform constructed in accordance with the teachings of the present invention.
Figure 7:
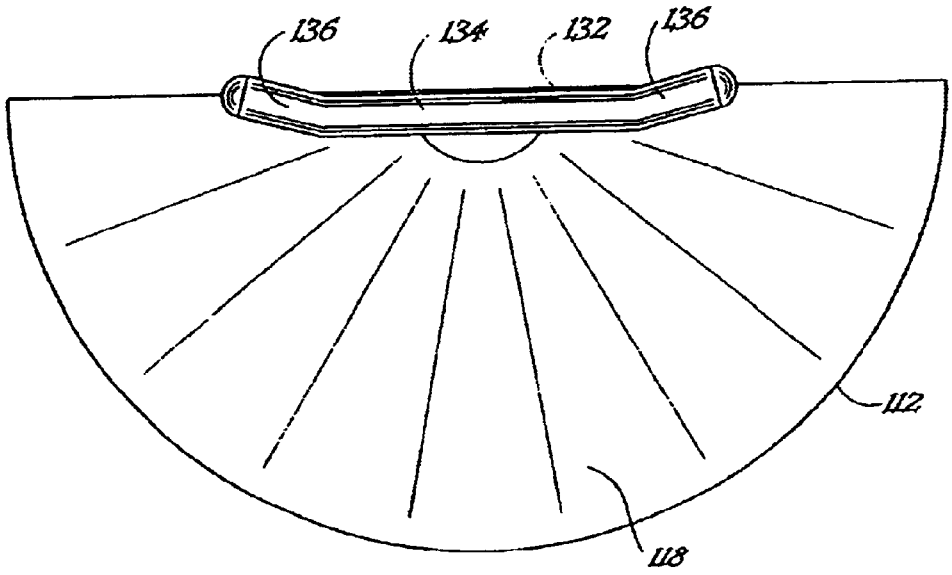
FIG. 7 is a top plan view of the anti-fatigue platform illustrated in FIG. 6.
Figure 8:
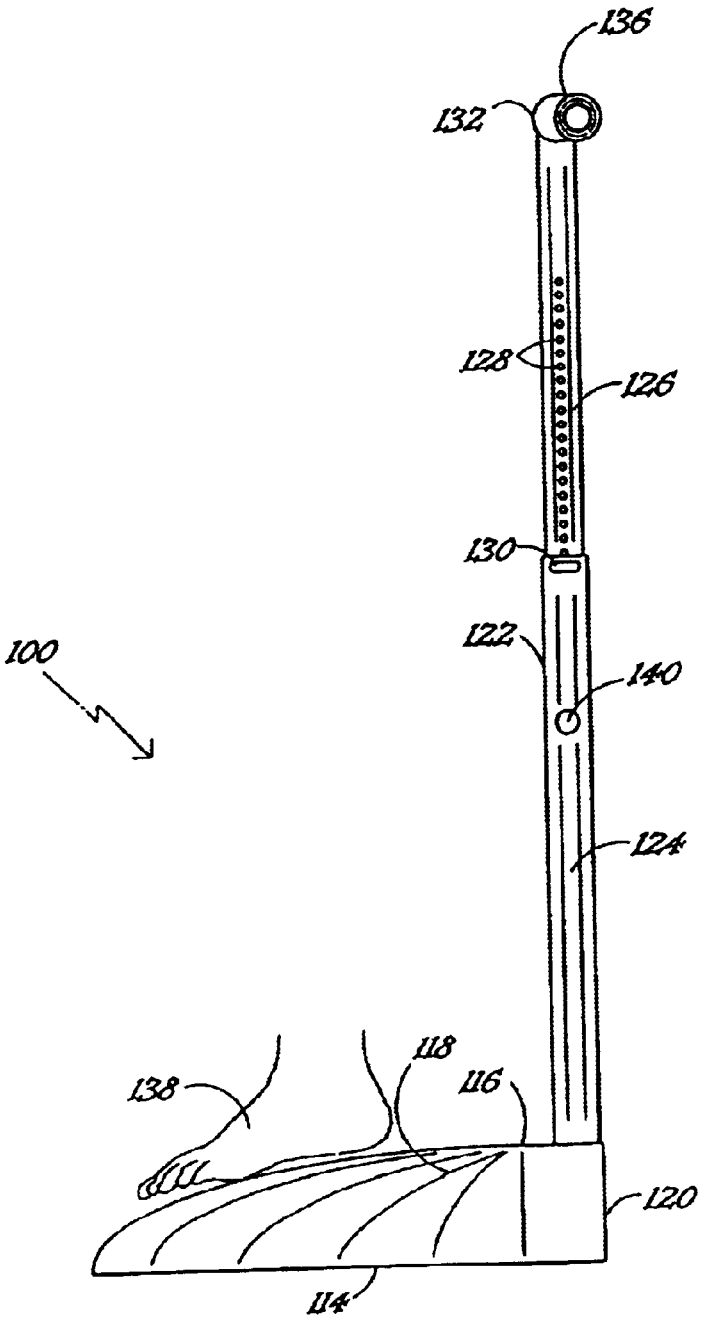
FIG. 8 is a side elevation view of the anti-fatigue platform illustrated in FIG. 6.
Figure 9:
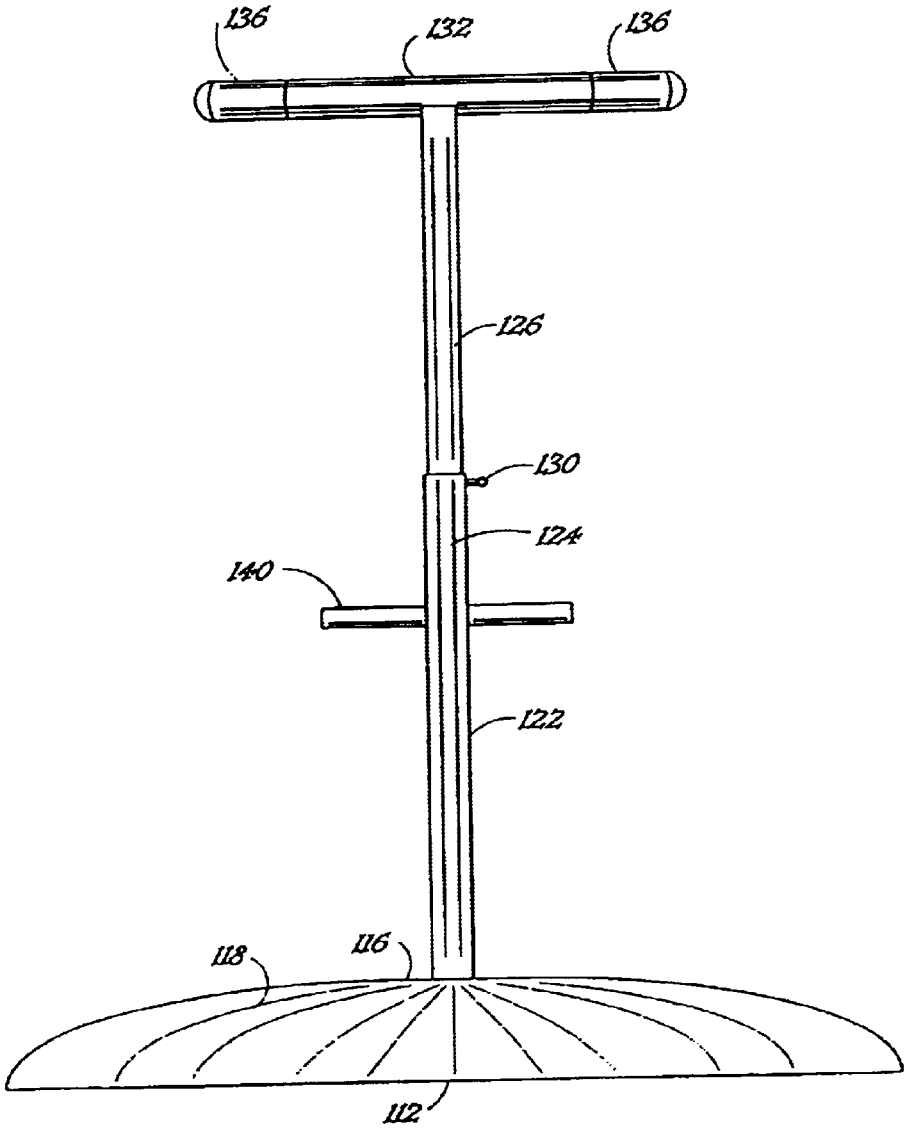
FIG. 9 is a front elevation view of the anti-fatigue platform illustrated in FIG. 6.
Figure 10:
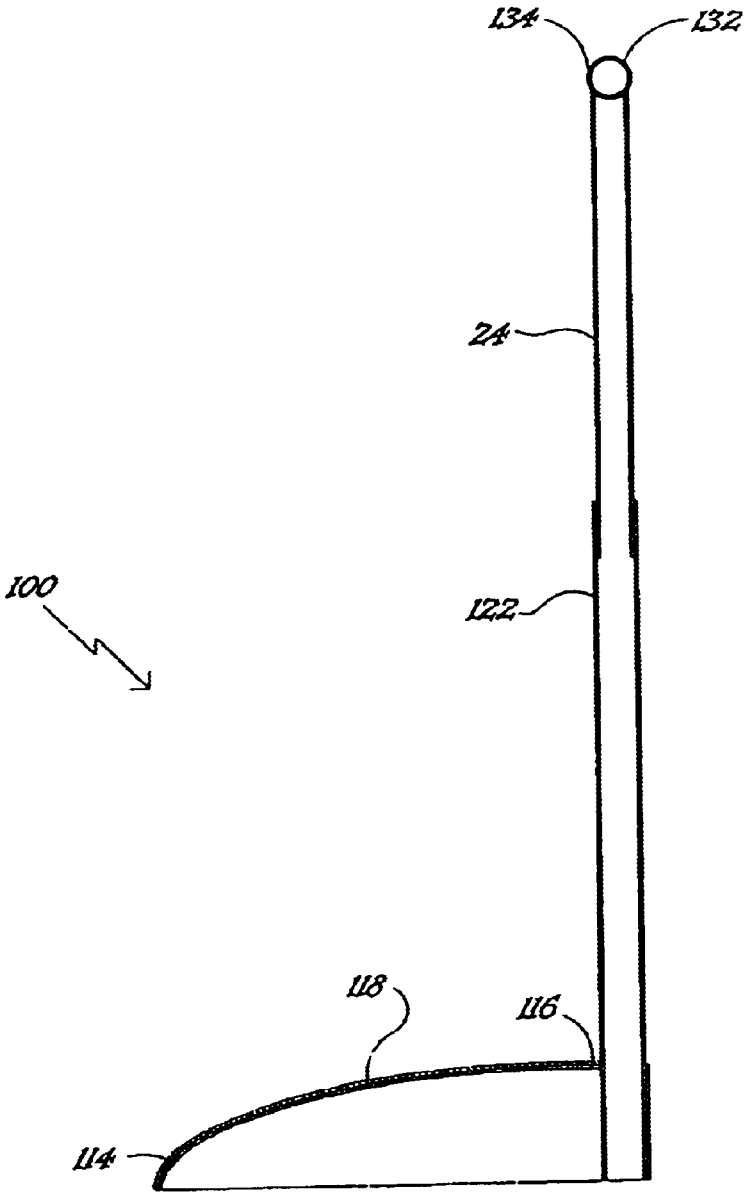
FIG. 10 is a side elevation view, in section, of the anti-fatigue platform illustrated in FIG. 6.
Figure 11:
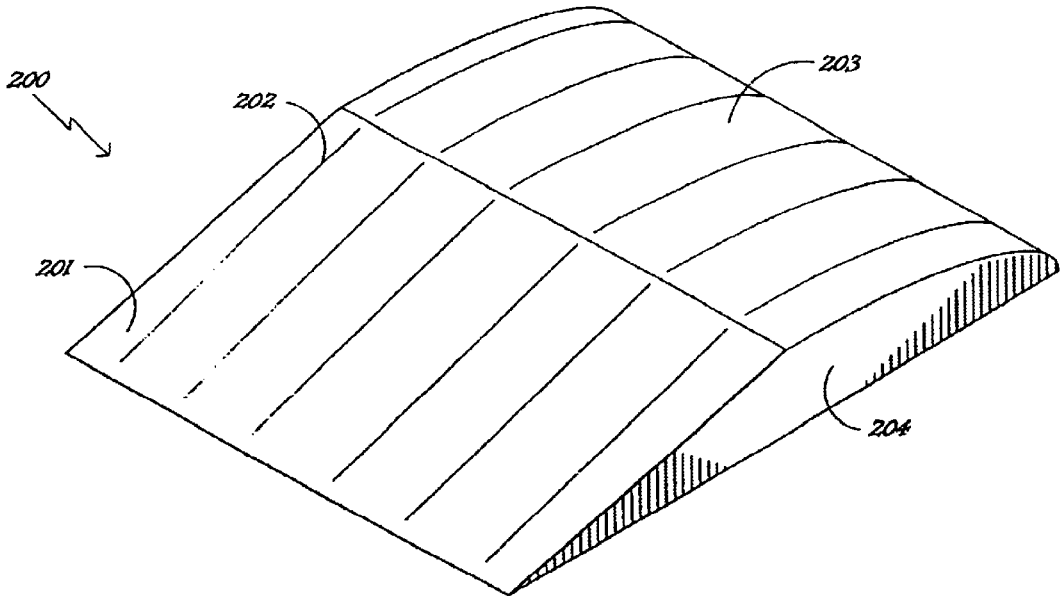
FIG. 11 is a perspective view of a third embodiment of anti-fatigue platform constructed in accordance with the teachings of the present invention.
Figure 12:
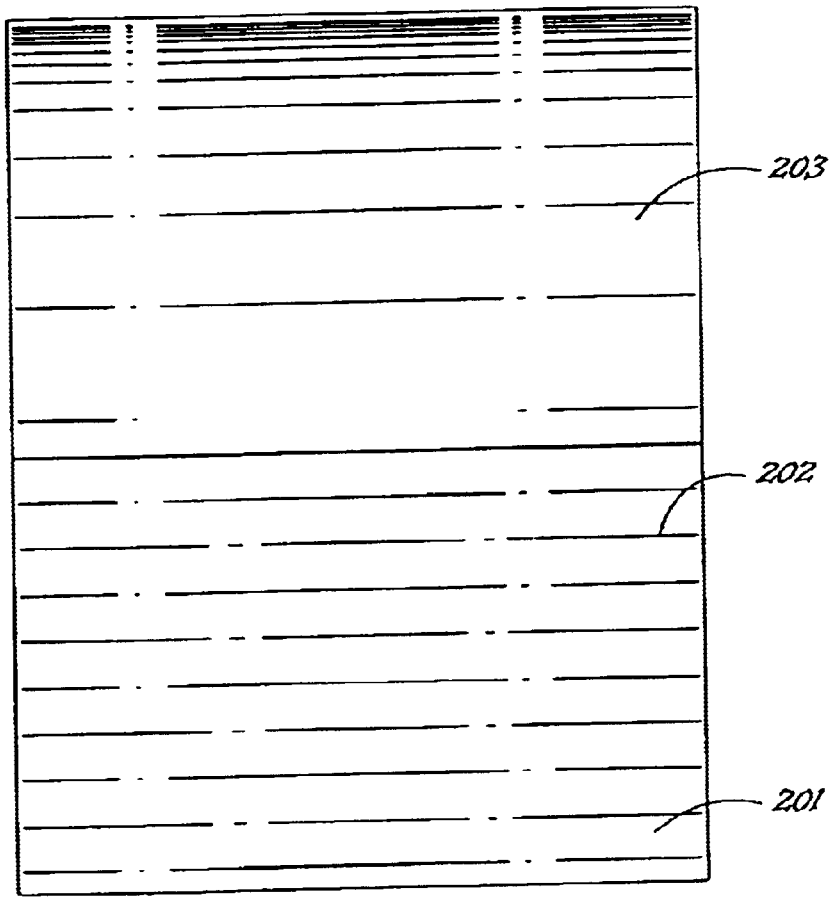
FIG. 12 is a top plan view of the anti-fatigue platform illustrated in FIG. 11.
Figure 13:
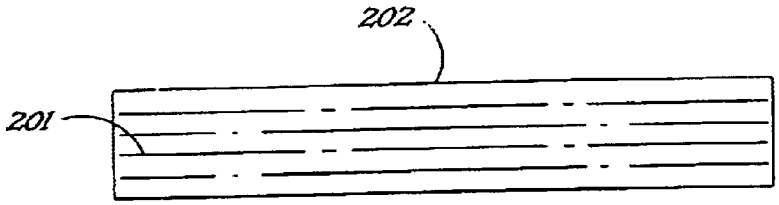
FIG. 13 is a front elevation view of the anti-fatigue platform illustrated in FIG. 11.
Figure 14:
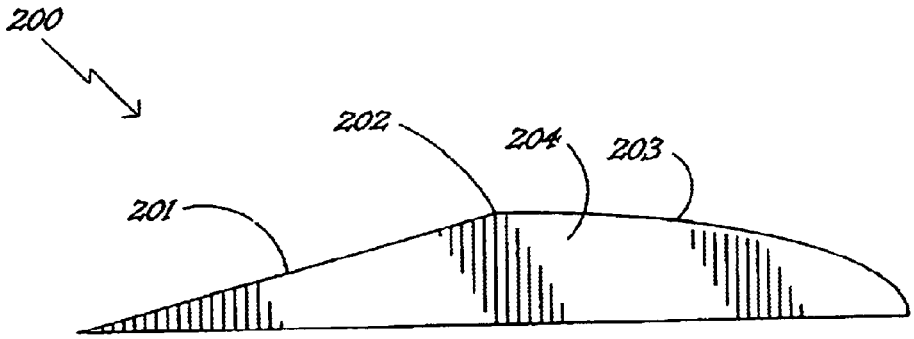
FIG. 14 is a side elevation view of the anti-fatigue platform illustrated in FIG. 11.

Referring to FIGS. 6 through 10, anti-fatigue platform 100 includes a resilient ellipsoid body 112 truncated to form a flat bottom surface 114 as illustrated in FIG. 8. Referring to FIGS. 8 and 10, ellipsoid body 112 has a downwardly sloped semi-circular upper surface 116, a sloped front surface 118 and a truncated oval back surface 120. Although a constant curvature would provide some benefits, it is preferred that a compound curvature be provided with the slope of front surface 118 being greater than slope of upper surface 116. Referring to FIG. 9, a support post 122 projects vertically from body 112. Vertical support post 122 has a first portion 124 and a second portion 126. First portion 124 is fixed to body 112. Second portion 126 is telescopically adjustable relative to first portion 124. Referring to FIG. 8, second portion 126 has a plurality of vertically spaced adjustment apertures 128. Second portion 126 is fixed in a position relative to first portion 124 by insertion of a locking pin 130 through one of adjustment apertures 128. In order to adjust the height of support post 122, locking pin 130 is removed and second portion 126 can then be moved either up or down till the desired height is reached. Locking pin 130 is then inserted through corresponding adjustment aperture 128 in second portion 126 so as to lock second portion 126 in a position relative to first portion 124. Referring to FIG. 6, vertical support post 122 has a transverse member 132. Transverse member 132 has a main body 134 and remote ends 136. Remote ends 136 are angularly offset from an axis of main body 134 on a substantially horizontal plane. A foot rest 140 is also provided on first portion 124 of vertical support post 122.

Operation of the Second Embodiment

The use and operation of anti-fatigue platform 100, will now be described with reference to FIGS. 6 through 10. As described with the first embodiment, anti-fatigue mat 10, a worker who is required to stand for a period of time, may reduce fatigue, particularly in the lower and mid back, by standing on anti-fatigue platform 100. Referring to FIG. 8, the worker places his or her feet 138 at any position along sloped upper surface 116 that feels comfortable. During use, a worker can relieve fatigue by moving either or both feet up or down sloped upper surface 116. Both feet can be maintained parallel or one foot can be toward the top of sloped upper surface 116, while the other foot is positioned toward the bottom of sloped upper surface 116. In addition, the worker can change the width of his or her stance and the direction the feet are pointing in relation to the semi-circular configuration of sloped upper surface 16. Toes can be pointed inwardly or toes can be pointed outwardly. However, anti-fatigue platform 100 differs from the first embodiment, anti-fatigue platform 10, in that the ellipsoid body provides a slope along front surface 118 which is greater than slope of upper surface 116. This provides is a curved slope of varying curvature, instead of a constant slope. When the worker stands upon a slope having a constant angle, whether the worker stands at the top of the slope or the bottom of the slope makes no material difference to positioning. In contrast, with a curved slope having a varying curvature, the angular positioning of the workers feet and angle vary depending upon where the worker stands up at sloped upper surface 116 or down toward sloped front surface 118. This provides the worker with a further alternative positioning when seeking a comfortable position. As with the first embodiment, in this second embodiment the worker can obtain additional support from support post 122. Support past 122 is adjusted so that the worker is able to comfortably lean the back of his or her upper legs or buttocks against transverse member 132. The height of support post 122 can be adjusted by removing locking pin 130. Second portion 126 is then moved either up or down until a desired height is reached. Locking pin 130 is then inserted through a selected one of adjustment apertures 128 so as to lock second portion 126 relative to first portion 124. As with the first embodiment, the worker can also relieve fatigue by resting one of his or her feet on foot rest 140 or by stretching against truncated back portion 120.

Structure and Relationship of Parts of Third Embodiment

Figure 15:
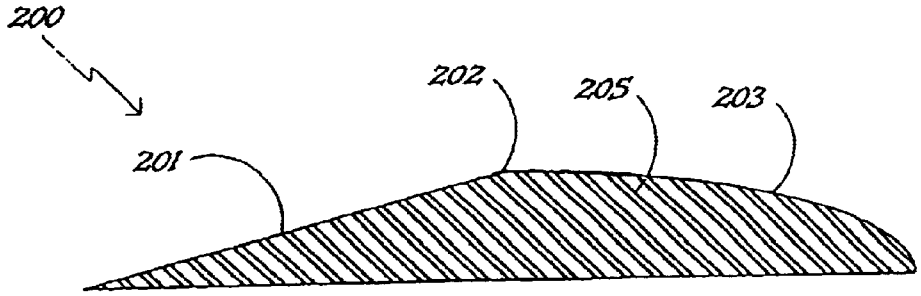
FIG. 15 is a side elevation view, in section, of the anti-fatigue platform illustrated in FIG. 11.

Anti-fatigue platform 200 will now be described with reference to FIGS. 11 through 15. Anti-fatigue platform 200 was developed for use along an assembly line or service counter. The configuration illustrated can be made in any desired length. It is anticipated that a number of employees will be standing on anti-fatigue platform 200 at any one time. Anti-fatigue platform 200 has an upper surface 202 that has two portions. A first portion 201 of upper surface 202 is a constant slope. A second portion 203 of supper surface 202 is a curved slope having a varying curvature. Anti-fatigue platform 200 has flat truncated ends 204. Referring to FIG. 15, anti-fatigue platform 200 has a solid core 205 made from a form retaining and yet resilient material, such as recycle rubber from vehicular tires.

Operation of the Third Embodiment

The use and operation of anti-fatigue platform 200, will now be described with reference to FIGS. 11 through 15. As described with the first embodiment, anti-fatigue mat 10, and the second embodiment, anti-fatigue mat 200, workers who are required to stand for a period of time, may reduce fatigue, particularly in the lower and mid back, by standing on anti-fatigue platform 200. The workers will first decide whether they prefer to use the constant slope of first portion 201 or the curved slope of varying curvature of second portion 203. When the surface has been selected, anti-fatigue platform 200 is positioned next to an assembly line or service counter so that the workers can stand on the selected one of first portion 201 or second portion 203 while performing their duties. The workers place their at any position along upper surface 202 that feels comfortable. During use, each worker can relieve fatigue by moving either or both feet up or down upper surface 202. Both feet can be maintained parallel or one foot can be toward the top of sloped upper surface 202, while the other foot is positioned toward the bottom of sloped upper surface 202. In addition, the worker can change the width of his or her stance and to a limited extent the direction the feet are pointing. There is not the same range of foot positioning possible as with the semi-circular body style of the first embodiment and the second embodiment. However, this trade off is necessary to enable one fatigue platform to service numerous workers, working in a common area. Support posts could be added to this third embodiment, but the spacing between workers along assembly lines and at service counters will vary. For this reason it is not presently contemplated that the third embodiment will be manufactured with support posts.

It is intended that the various embodiments of anti-fatigue platform will be manufactured from a material that will maintain the desired slopes and curvatures, while providing some resiliency. Of course, the main body can be manufactured from a rigid material and then covered with a covering that would provide some resiliency for the greater comfort of the user.

Fatigue can be traced, in part, to poor posture and having to maintain a single position for a prolonged period. The anti-fatigue platforms, as described, maintains the worker in a vertical equilibrium of good posture which reduces lower and mid back muscular stress. At the same time, the worker is able to change foot positioning during use to virtually any medial or lateral rotation of the angle, to alleviate the stress in the angle region that might otherwise occur from having to maintain a single position for a prolonged period of time.

Insights into why the anti-fatigue platforms, as described, reduce fatigue can be obtained from reviewing publications on muscle functioning such as "MUSCLES ALIVE" by John V Basmajian, fourth edition, published by Waverly Press, Inc. Baltimore Md. In his publication, Dr. Basmajian notes that there are problems associated with "static" posture which make walking less fatiguing than standing. He also notes that shifting from foot to foot is one means of providing relief by periodically allowing the leg muscles to become unloaded and relaxed. The anti-fatigue platforms, described, enable the worker to stand comfortably erect. They also provide for some alternative positioning to load the foot, ankle and leg muscles differently and periodically to unload the muscles through the use of the foot rests.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. An anti-fatigue platform, for reducing fatigue of a person, comprising:

a resilient body having a curved perimeter bottom edge, a sloped surface and a top surface with a curved perimeter top edge, the bottom edge and the top edge being concentric half circles, the sloped surface being connected to the curved perimeter bottom edge and connected to the curved perimeter top edge, the sloped surface tapering radially outward from the curved perimeter top edge toward the curved perimeter bottom edge, and the sloped surface being sufficiently dimensioned so as to accommodate a person's feet and support the feet of such person in a standing position during use of the anti-fatigue platform, and an area of the top surface of the anti-fatigue platform being smaller than an area of the sloped surface;

the sloped surface having a slope of between 5 degrees and 35 degrees; and a support post supported by the top surface of the resilient body substantially normal to the top surface, the support post being adapted to provide support to a person standing upon the sloped surface.

2. The anti-fatigue platform according to claim 1, wherein the sloped surface has a planar slope from the top edge to the bottom edge.

3. The anti-fatigue platform according to claim 1, wherein the sloped surface has a constant curvature from the top edge to the bottom edge.

4. The anti-fatigue platform according to claim 1, wherein the sloped surface has a compound curvature from the top edge to the bottom edge.

5. The anti-fatigue platform according to claim 1, wherein the sloped surface comprises a radially outer sloped surface with a greater slope than a radially inner sloped surface.

6. The anti-fatigue platform according to claim 1, wherein the resilient body has a truncated back surface.

7. The anti-fatigue platform according to claim 1, wherein the vertical support post has a transverse member.

8. The anti-fatigue platform according to claim 7, wherein the transverse member has a main body and remote ends, and the remote ends are angularly offset from an axis defined by the main body of the transverse member.

9. The anti-fatigue platform according to claim 1, wherein an intermediate region of the support post supports a pair of foot rests which extend perpendicular to the support post.

10. The anti-fatigue platform according to claim 1, wherein the vertical support post has a first portion and a second portion, with the second portion being axially adjustable relative to the first portion.

* * * * *